US009120024B2

(12) United States Patent
Shah

(10) Patent No.: US 9,120,024 B2
(45) Date of Patent: Sep. 1, 2015

(54) WATER BASED AMUSEMENT STRUCTURE

(71) Applicant: Arihant Industrial Corporation Limited, Vasai (East) (IN)

(72) Inventor: Rajen S. Shah, Vasai (IN)

(73) Assignee: Arihant Industrial Corporation Limited, Vasai (East) (IN)

( * ) Notice: Subject to any disclaimer, the term of this patent is extended or adjusted under 35 U.S.C. 154(b) by 5 days.

(21) Appl. No.: 14/076,525

(22) Filed: Nov. 11, 2013

(65) Prior Publication Data

US 2014/0135138 A1 May 15, 2014

(30) Foreign Application Priority Data

Nov. 12, 2012 (IN) ..... 3284/MUM/2012

(51) Int. Cl.
*A63G 31/00* (2006.01)
*A63B 33/00* (2006.01)

(52) U.S. Cl.
CPC ..... *A63G 31/007* (2013.01)

(58) Field of Classification Search
CPC ..... A63G 31/00; A63G 31/007; A63G 33/00; A63B 67/007; A63B 2009/008; A63B 2009/006
USPC ..... 472/13, 117, 128, 129, 136
See application file for complete search history.

(56) References Cited

U.S. PATENT DOCUMENTS

| | | | | |
|---|---|---|---|---|
| 6,132,318 | A * | 10/2000 | Briggs | 472/128 |
| 6,319,139 | B1 | 11/2001 | Tracy | |
| 6,746,334 | B1 * | 6/2004 | Barney | 472/128 |
| 7,967,692 | B2 * | 6/2011 | Werner | 472/117 |
| 8,210,194 | B2 * | 7/2012 | Rehkemper | 135/96 |

FOREIGN PATENT DOCUMENTS

| | | |
|---|---|---|
| CN | 2403466 Y | 11/2000 |
| CN | 2686657 Y | 3/2005 |

* cited by examiner

*Primary Examiner* — Kien Nguyen
(74) *Attorney, Agent, or Firm* — The Webb Law Firm

(57) ABSTRACT

A water based amusement structure includes: a ring shaped base; a dome like structure fixed on the ring shaped base, wherein the ring shaped base and dome like structure define an amusement area; a plurality of water carrying lines, wherein each water carrying line includes at least one opening for providing a splashing path; a plurality of lighting means for illuminating the amusement area; a plurality of at least one of the following: disco lights, beam lights, strip lights, laser beam lights, disco floor, ceiling lights, mounted fountains, entrance fog effect water jets, and sprinklers; a music system fixed inside the amusement area; a support structure having a base and an elongated portion fixed on the base, wherein the ring shaped base rests on the elongated structure; at least one ladder like structure; and a temperature control system with a fan provided in different locations for a cyclonic effect.

19 Claims, 3 Drawing Sheets

WATER BASED AMUSEMENT STRUCTURE

CROSS-REFERENCE TO RELATED APPLICATION

This application claims priority to Indian Patent Application No. 3284/MUM/2012 filed Nov. 12, 2012 in the Indian Intellectual Property Office, the disclosure of which is hereby incorporated by reference in its entirety.

FIELD OF THE INVENTION

The present invention relates to water based amusement attraction. More particularly, the invention relates to an amusement device in which participants are actively involved in a water attraction. Further, the invention relates to water based amusement structure in which participant can enjoy the rain dance.

BACKGROUND OF THE INVENTION

Water based play structures used in water parks are well known. For example the U.S. Pat. No. 6,319,139 discloses water park play apparatus It discloses a user actuated water park amusement device comprising, an elongated tubular member defining an axially extending bore and having an inlet end, an outlet end, and a water nozzle being spaced proximate said outlet end, a base for securing said tubular member in a generally upright orientation with said outlet end spaced vertically above said inlet end, a water supply conduit for providing water flow vertically along said bore and outwardly from said nozzle, said tube being characterized by a generally rigid lower portion and a semi rigid upper portion, the upper portion having a rigidity selected whereby in a relaxed state the tubular member maintaining said generally upright orientation aligned with said axis, and wherein the application of rotational or vibrational forces on said tube by the user produces deflection of the upper portion of the tubular member relative to the axis, without significant deflection of the lower end.

The Chinese Pat. No. CN2686657 discloses a fireproof automatic water spraying valve, belonging to the technical field of the extinguisher. The fireproof automatic water spraying valve is characterized in that a valve body, a water preventing valve which is movably arranged in the valve body, a valve formed by an elastic device and an anchor line, and a water spraying device are arranged between the inlet pipe and the outlet pipe. The elastic device is arranged between the valve body and the water preventing valve. The fireproof automatic water spraying valve solves the problem that the present fireproof automatic water spraying device has the disadvantages of expensive price, easy false alarm, and inconvenient installation. The fireproof automatic water spraying valve is widely applied to the family, the market, the amusement park, etc.

Another Chinese Pat. No. CN 2403466 provides an amusement fountain device, which comprises a downward conical nozzle, a pile body positioned at the lower side of the conical nozzle, and an elastic pedal arranged on the pile body, wherein, the elastic pedal is used for controlling a valve of the conical nozzle. When a player sets feet on the pedal, a conical fountain can be generated to cover the player. Thus, the utility model has strong interesting performance, and is suitable for amusement places which particularly are amusement places on water.

Another kind of water based amusement attraction is rain dance in which participants feel that they are dancing in the rain. To provide this attraction the available amusement structures are mostly open from all sides I.e. structure is without roof and walls. Such kinds of amusement structures are not suitable for female participants because of privacy problem. Also excitement level in such amusement structure is very less.

The aforementioned water play structures are designed to permit interactive participation by a user, as for example, by having user activated valves or the like, the size and complexity of manufacture makes their manufacture prohibitively expensive for all but the largest theme parks. Further, these conventional water play structures suffer the disadvantage in that they are both expensive to maintain and repair, for example, damage occur to the play structure. Hence there is need to provide a water based play structure which will be free from aforesaid problems and disadvantages.

OBJECT OF THE INVENTION

The main object of the invention is to provide a water based amusement structure which eliminates deficiencies associated with the conventional water based amusement structures.

Another object of the invention is to provide a water based amusement structure which is easy to maintain.

Another object of the invention is to provide a water based amusement structure which has pleasant appearance with spaceship structure and/or other design structure of different shapes.

Another object of the invention is to provide a water based amusement structure which is closed from all sides so that participant can have some privacy, especially in case of female participant.

Another object of the invention is to provide a water based amusement structure in which participants can enjoy rain dance with music and lighting effects.

Another object of the invention is to provide a water based amusement structure in which participant can enjoy rain dance with hot and cold water with heavy duty fans for cyclonic effect.

Another object of the invention is to provide a water based amusement structure in which participants can enjoy rain dance with effects of fog, mist and aroma.

Another object of this invention is to provide the different part of this Rain Dance is a theme of our product i.e. spaceship structure and/or other design structure of different shapes with a disc encompassing a dance floor with multiple light, sound, artificial rain, water and special effects.

SUMMARY OF THE INVENTION

Accordingly to achieve the foregoing objects the present invention provides a water based amusement structure inside which participants can enjoy rain dance, the amusement structure comprising:

- a ring shaped base with spaceship structure and/or other design structure of different shapes cover;
- a dome like structure to be fixed on the ring shaped base, the ring shaped base and dome like structure define an amusement area for the participants;
- a plurality of water carrying lines being placed inside the amusement area, the each water line includes at least one opening for providing splashing path to the water inside the amusement area;
- a plurality of lighting means being placed inside the amusement area to illuminate the amusement area, music system fixed inside the amusement area in a waterproof manner;

a support structure having base and an elongated portion fixed on the base, the ring shaped base defining the amusement area rests on the elongated structure; and at least one ladder like structure for enabling the participants to reach the amusement area from the base of support structure.

According to an embodiment of the invention the ring shaped base define a dance floor area for the participants.

According to another embodiment of the invention the ring shaped base defining the amusement area is fixed on the elongated structure.

According to yet another embodiment of the invention the ring shaped base defining the amusement area is rotatably mounted on the elongated structure.

According to another embodiment of the invention the ring shaped base is made of fiber glass reinforced plastic.

According to another embodiment of the invention the dome like structure is made of transparent plastic material and typically made of fiber glass reinforced plastic. According to another embodiment of the invention the water carrying lines are placed on inner periphery of the ring shaped base and inner periphery of the dome like structure. A nozzle and/or shower is fixed in the openings of water carrying line.

According to another embodiment of the invention the lighting means are fixed in water proof manner on the dance floor area, inner periphery of the ring shaped base and inner periphery of the dome like structure.

According to further embodiment of the invention the support structure is made of mild steel.

According to another embodiment of the invention the amusement structure is in the shape of spacecraft.

The present invention also discloses an amusement article inside which participants can enjoy rain dance, the amusement article comprising:

a ring shaped dance floor area being rotatatbly mounted on an elongated MS (Mild Steel) structure, a fiberglass reinforced plastic (FRP) dome being fixed on the ring shaped dance floor area;

a plurality of pipes for carrying water, the pipes are placed on inner periphery of the ring shaped dance floor area and inner periphery of the FRP dome;

at least one nozzle and/or shower being connected to each pipe for permitting slashing entry of water into dance floor area;

a plurality of multicolor lights being placed in a water resistant manner on dance floor, inner periphery of the ring shaped dance floor area and inner periphery of the FRP dome; and a plurality of disco lights, Beam Lights, Strip Lights, Laser beam lights, Disco Floor, Ceiling lights, Mounted fountains, entrance fog effect etc. water jets, sprinklers etc.;

at least one ladder like structure for enabling the participants to reach the dance floor area from ground.

MEANING OF THE REFERENCE NUMERALS USED IN THE FIGS. 1 TO 3

Figure 1:
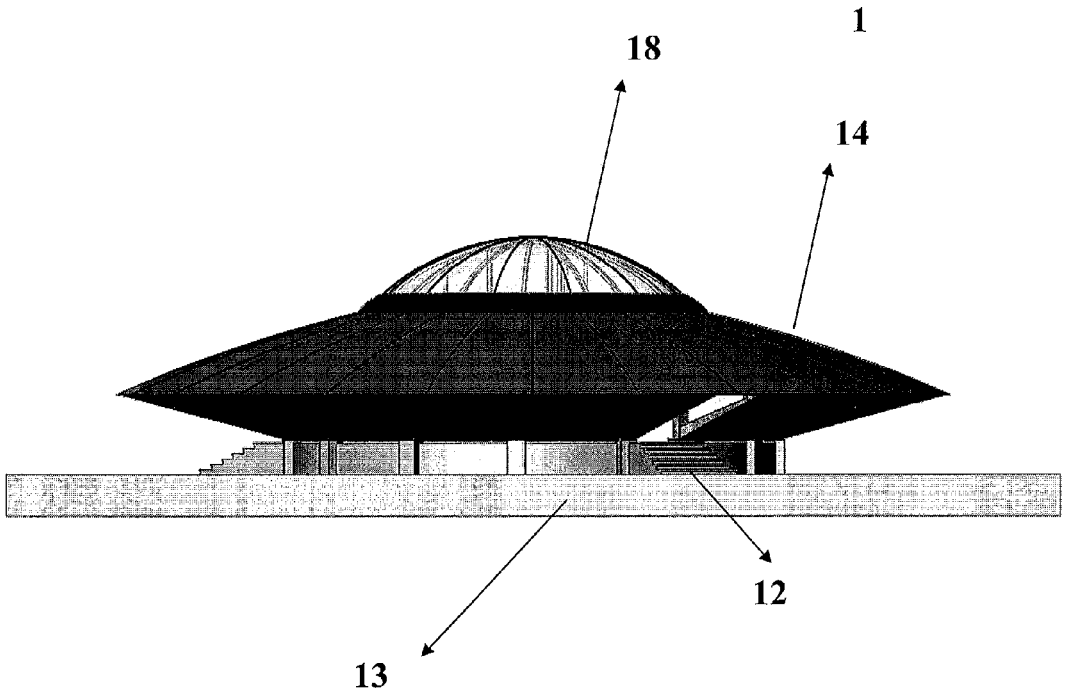
FIG. 1: shows perspective view of spaceship structure and/or other design structure of different shapes and types of rain dance structure with entrance and exit arrangement of a water based amusement structure in accordance to present invention.

1: Amusement structure
2: Ring shaped dance floor area
3: Inner periphery of ring shaped dance floor area
4: FRP dome/polycarbonate dome
5: Inner periphery of dome
6: Water pipes
7: Nozzle/shower
8: Lights
9: Support structure
10: Base of support structure
11: Elongated portion of support structure
12: Staircase
13: Opening for entry of the participant
14.: Spaceship cover
15.: Circulating Water
16.: Temperature control system
17.: Heavy Duty Fan
18. Transparent Cover

DETAILED DESCRIPTION OF THE INVENTION

The following is a detailed description of the invention with reference to accompanying drawings.

Figure 2:
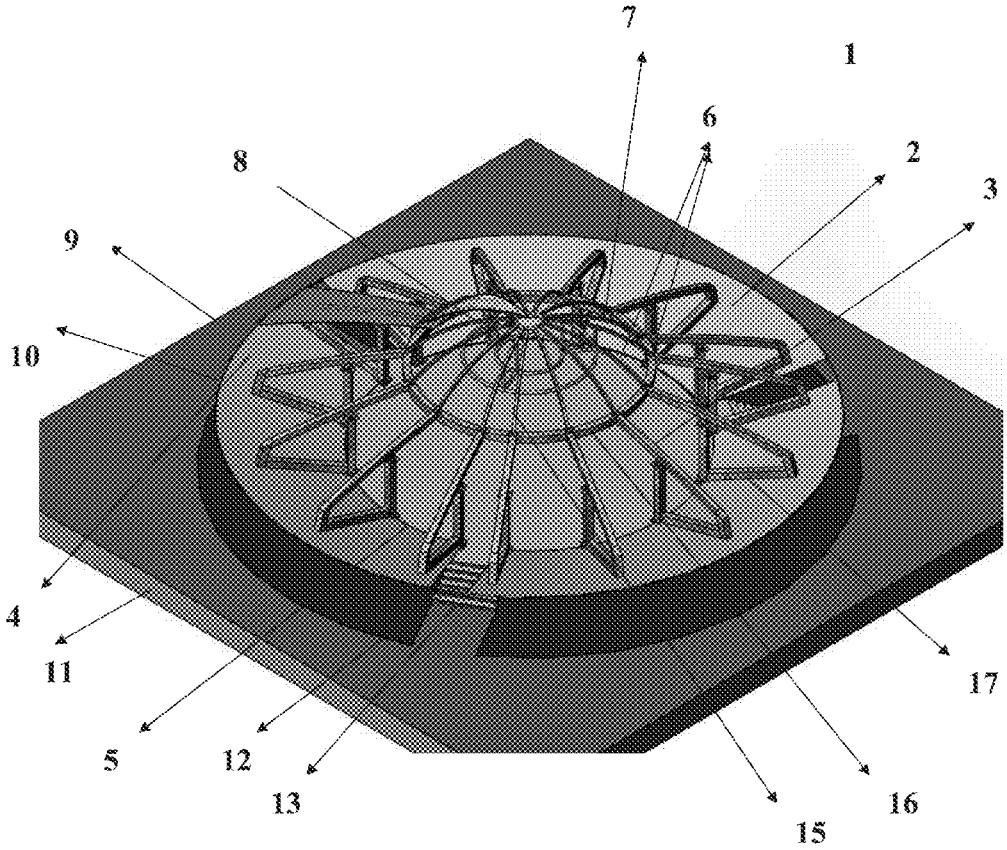
FIG. 2: shows sectional diagram of the present invention
Figure 3:
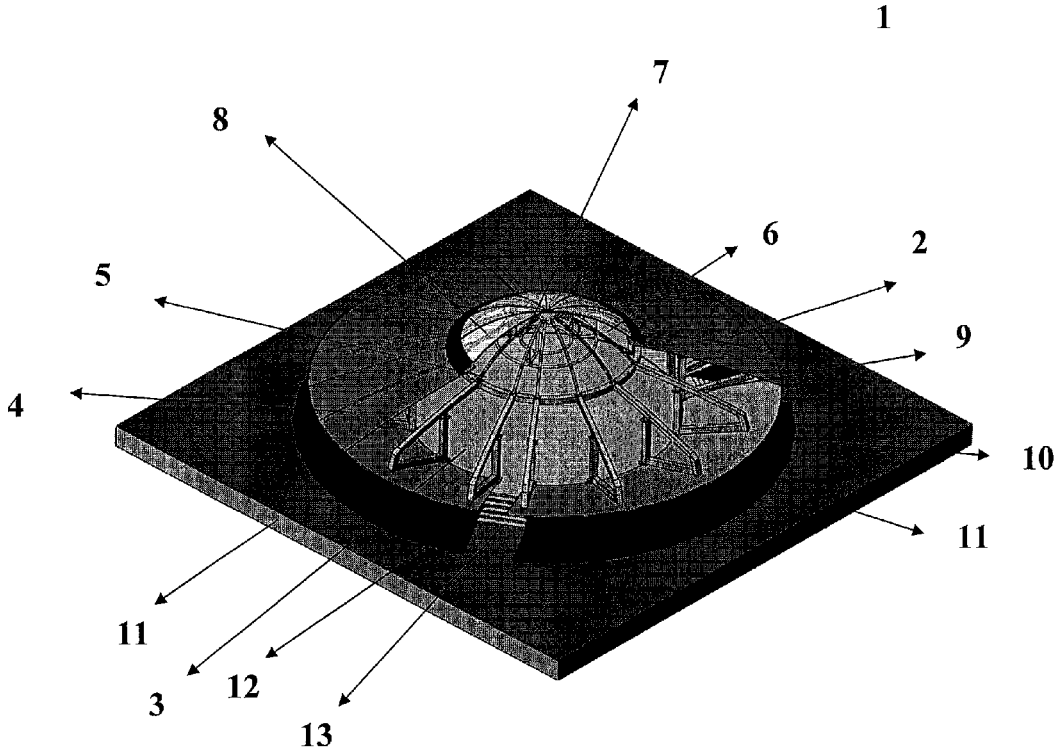
FIG. 3: shows sectional view of the rain dance structure of the present invention.

Referring to FIGS. 1-3, the water based amusement structure (1) includes ring shaped dance floor area (2) and dome (4). The dome (4) is placed on the ring shaped dance floor area (2). The ring shaped dance floor area (2) and dome (4) make the closed amusement area for the floor on which participants can dance. Both ring shaped dance floor area (2) and dome (4) are made of transparent plastic material and typically Fiberglass Reinforced Plastic (FRP) is used.

The Polycarbonate/Fiberglass Reinforced Plastic (FRP) has excellent versatility, and Polycarbonate/Fiberglass Reinforced Plastic (FRP) domes can replicate stone, wood, metal and terra cotta. Polycarbonate/Fiberglass Reinforced Plastic (FRP) domes can be cast in bright colors or even gold leafed. Polycarbonate/Fiberglass Reinforced Plastic (FRP) domes are lightweight and Polycarbonate/Fiberglass Reinforced Plastic (FRP) domes have a high ratio of strength to weight. Being produced from resins and FRP cloth is what gives Polycarbonate/Fiberglass Reinforced Plastic (FRP) domes the ability to be molded into almost any shape, including complex dome shapes. Polycarbonate/Fiberglass Reinforced Plastic (FRP) domes are able to be integrally colored, painted or gold leafed. On the jobsite, Polycarbonate/Fiberglass Reinforced Plastic (FRP) domes are easy and quick to install.

RAIN DISC is a Rain Dance consisting of shaded discos and rain showers which is fully equipped with acoustics and theatre lighting for pulsating performances the non-stop high voltage music and attractive lighting effects created by these systems.

The design of the rain dance comprise of a spaceship structure and/or other design structure of different shapes entering a disc with multiple dazzling light effect, artificial rain and music.

It consists of various disco lights, Beam Lights, Strip Lights, Laser beam lights, Disco Floor, Ceiling lights, Mounted fountains, entrance fog effect etc. water jets, sprinklers etc.

Water flow rate for Rain Dance is 6000 LPM

Size: Area Dance Floor: 1490 sq. ft.

Ht: 19 ft max
Width: 77 ft. Dia
Power Consumption –12 kvA
Pump Capacity –6000 LPM
Capacity: Approx 130 persons on Dance floor
(Can be increased as per the requirement)

Visitors Experience: Family chilling down, dancing through the day having a blast with their friends. For fun lovers and tourists looking for some real amusements with your loved ones in rain and music on dance floor.

Products Aims: to serve water park lovers with a different and attractive theme of our saucer dance full of music and water jets enjoy to the core.

Unique: The different part of this Rain Dance is a theme of our products i.e. spaceship structure and/or other design structure of different shapes with a disc encompassing a dance floor with multiple light, sound, artificial rain, water and special effects, temperature, central system for water and air having heavy duty/fans for at different location for cyclonic effect.

The Following are the Advantages of FRP Dome:
FRP domes are easy and quick to install
FRP domes are low cost
FRP domes are rot resistant
FRP Domes do not rust
FRP domes are highly corrosion resistant
FRP domes are weather resistant
FRP domes are easily repaired if ever damaged
Strength & durability of FRP domes is exceptional
FRP domes are flame, flood & earthquake resistant
FRP Domes: Color and Texture Options.
Metallics: Bronze, gold, gold leaf, copper, aged bronze, aged copper, nickel and custom metallic.
Stone: limestone, sandstone, marble, granite and custom stone.
Colors: Any color from any paint chart.
Textures: smooth, aged metal, stone, travertine, distressed, mosaic tile, barrel tile, wood grain and custom textures.

The main aim of this amusement structure (1) is to make the participants feel as if they are dancing in the rain. To create artificial rain a plurality of pipes (6) in combination with nozzles and/or showers (7) are provided. These pipes (6) are placed on the inner periphery of ring shaped dance floor area (3) and inner periphery of the FRP dome (5). The amusement structure may include means (not shown in figures) to control flow of water. The water pipes (6) are mainly made of plastic material.

The amusement structure (1) further includes lighting means (8) and music system (not shown in figures) to make the overall environment in the rain dance dynamic and highly thrilling. The DJ sound speakers and disco lights make the amusement structure (1) more appealing. The lighting means (8) and music system are installed in the amusement area in a waterproof manner.

The amusement structure (1) further includes supporting structure (9). The support structure (9) has a base part (10) and an elongated part (11). The dance floor area (2) rests on the elongated part (11). The support structure is mainly made of mild steel material. Multiple staircases (12) are provided on the base part (10) of the support structure (9). BY using these staircases (12) participants can reach to dance floor area (2) from the base part (10). At least one opening (13) s provided in dance floor area (2) for the entry of the participants; the temperature central system for air and water and having H.D fan in different area to have cyclonic effect. A spaceship cover (14) curved base line fan circulating water (15) temperature control system (16) heavy duty fans (17) for cyclonic effect with transparent cover (18).

The amusement structure (1) is completely like a spaceship structure and/or other design structure of different shapes. New and innovatively designed as compared to conventional one. Its disco lights and water sprinklers make it hottest spot for the dance loving community.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

I claim:

1. A water based amusement structure inside which participants can enjoy rain dance, the amusement structure comprising:
- a ring shaped base with spaceship structure and/or other design structure of different shapes cover;
- a dome like structure to be fixed on the ring shaped base, wherein the ring shaped base and dome like structure define an amusement area for the participants;
- a plurality of water carrying lines being placed inside the amusement area, wherein each water carrying line includes at least one opening for providing splashing path to the water inside the amusement area;
- a plurality of lighting means for illuminating the amusement area, which are placed inside the amusement area;
- a plurality of at least one of the following: disco lights, beam lights, strip lights, laser beam lights, disco floor, ceiling lights, mounted fountains, entrance fog effect, water jets, and sprinklers;
- a music system fixed inside the amusement area in a waterproof manner;
- a support structure having a base and an elongated portion fixed on the base, wherein the ring shaped base defining the amusement area rests on an elongated structure;
- at least one ladder like structure for enabling the participants to reach the amusement area from the base of the support structure; and
- a temperature control system, for the water as well as the air inside the amusement area, with a fan provided in different locations for a cyclonic effect.

2. The water base amusement structure as claimed in claim 1, wherein the temperature central system for water and air includes a heavy duty fan for the cyclonic effect.

3. The water base amusement structure as claimed in claim 1, further comprising a structure with nozzles and fans for inside effects of fog, mist and aroma.

4. The water based amusement structure as claimed in claim 1, wherein the ring shaped base defines a dance floor area for the participants.

5. The water based amusement structure as claimed in claim 1, wherein the ring shaped base defining the amusement area is fixed on the elongated structure.

6. The water based amusement structure as claimed in claim 1, wherein the ring shaped base defining the amusement area is rotatably mounted on the elongated structure.

7. The water based amusement structure as claimed in claim 6, wherein the dome like structure is made of fiber glass reinforced plastic/polycarbonate.

8. The water based amusement structure as claimed in claim 1, wherein the ring shaped base is made of fiber glass reinforced plastic.

9. The water based amusement structure as claimed in claim 1, wherein the dome like structure is made of transparent plastic material.

10. The water based amusement structure as claimed in claim 1, wherein the water carrying lines are placed on an inner periphery of the ring shaped base and an inner periphery of the dome like structure.

11. The water based amusement structure as claimed in claim 1, wherein a nozzle is fixed in the openings of each water carrying line.

12. The water based amusement structure as claimed in claim 1, wherein a shower is fixed in the openings of each water carrying line.

13. The water based amusement structure as claimed in claim 1, wherein each lighting means is fixed in a water proof manner on the dance floor area, an inner periphery of the ring shaped base and an inner periphery of the dome like structure.

14. The water based amusement structure as claimed in claim 1, wherein the support structure is made of mild steel.

15. The water based amusement structure as claimed in claim 1, wherein the amusement structure is in the shape of a spacecraft.

16. An amusement article inside which participants can enjoy rain dance, the amusement article comprising:

a ring shaped dance floor area being rotatably mounted on an elongated mild steel (MS) structure;

a fiberglass reinforced plastic (FRP) dome fixed on the ring shaped dance floor area;

a plurality of pipes for carrying water, wherein the pipes are placed on an inner periphery of the ring shaped dance floor area and an inner periphery of the FRP dome;

at least one nozzle and/or shower connected to each pipe for permitting slashing entry of water into dance floor area;

a plurality of multicolor lightsplaced in a water resistant manner on the ring-shaped dance floor, the inner periphery of the ring shaped dance floor area and the inner periphery of the FRP dome; and at least one ladder like structure for enabling the participants to reach the dance floor area from ground.

17. The amusement article as claimed in claim 16, further comprising a music system fixed in the ring-shaped dance floor area in a waterproof manner.

18. The amusement article as claimed in claim 16, further comprising a temperature control system, for the water as well as the air inside the amusement article, with a fan provided in different locations for a cyclonic effect.

19. The amusement article as claimed in claim 16, further comprising a structure with nozzles and fans for inside effects of fog, mist, and aroma.

* * * * *

UNITED STATES PATENT AND TRADEMARK OFFICE

CERTIFICATE OF CORRECTION

PATENT NO. : 9,120,024 B2
APPLICATION NO. : 14/076525
DATED : September 1, 2015
INVENTOR(S) : Rajen S. Shah It is certified that error appears in the above-identified patent and that said Letters Patent is hereby corrected as shown below:

In the Claims

Column 6, Line 56, Claim 2, delete "base" and insert -- based --

Column 6, Line 59, Claim 3, delete "base" and insert -- based --

Column 8, Line 14, Claim 16, delete "lightsplaced" and insert -- lights placed --

Signed and Sealed this
Fifteenth Day of March, 2016

Michelle K. Lee

Michelle K. Lee
*Director of the United States Patent and Trademark Office*